US007685977B2

(12) United States Patent
Wagner et al.

(10) Patent No.: US 7,685,977 B2
(45) Date of Patent: Mar. 30, 2010

(54) INTERNAL COMBUSTION ENGINE

(75) Inventors: Johann Wagner, Graz (AT); Helmut Melde-Tuczai, Graz (AT); Johannes Rieger, Semriach (AT)

(73) Assignee: AVL List GmbH, Graz (AT)

( * ) Notice: Subject to any disclaimer, the term of this patent is extended or adjusted under 35 U.S.C. 154(b) by 374 days.

(21) Appl. No.: 11/630,404

(22) PCT Filed: Jun. 23, 2005

(86) PCT No.: PCT/AT2005/000221

§ 371 (c)(1),
(2), (4) Date: Jan. 30, 2007

(87) PCT Pub. No.: WO2006/000004

PCT Pub. Date: Jan. 5, 2006

(65) Prior Publication Data

US 2007/0245987 A1 Oct. 25, 2007

(30) Foreign Application Priority Data

Jun. 24, 2004 (AT) ..... A 1071/2004
Jul. 1, 2004 (AT) ..... A 1118/2004
Jul. 20, 2004 (AT) ..... A 1234/2004

(51) Int. Cl.
*F01L 1/34* (2006.01)

(52) U.S. Cl. ..... 123/90.16; 123/90.15; 123/90.6

(58) Field of Classification Search ..... 123/90.16, 123/90.15, 90.6
See application file for complete search history.

(56) References Cited

U.S. PATENT DOCUMENTS 1,439,798 A 12/1922 Crane
4,498,352 A 2/1985 Hedelin (Continued)

FOREIGN PATENT DOCUMENTS

DE 2456752 8/1976

(Continued)

OTHER PUBLICATIONS

English Abstract of EP1375843.

(Continued)

*Primary Examiner*—Zelalem Eshete
(74) *Attorney, Agent, or Firm*—Dykema Gossett PLLC

(57) ABSTRACT

An internal combustion engine has at least one cylinder and at least one gas exchange valve (1; 1*a*, 1*b*) controlled by a first cam (14) on a first camshaft (16) and by a second cam (15) on a second camshaft (17), at least one camshaft (16, 17) having an adjustable phase position in order to modify the control times of the gas exchange valve (1; 1*a*, 1*b*). The first cam (14) acts upon actuating means (6, 10) and the second cam (15) upon actuating means (6, 10) which actuate the gas exchange valve (6, 10). The actuating means (6, 10) are designed in such a way that the gas exchange valve (1) opens only when both the first cam (14) and the second cam (15) are acting upon the actuating means (6, 10). A simple structure with very high degrees of freedom for the control is achieved in that the actuating means (6, 10) comprise a lever which actuates the gas exchange valve (1; 1*a*, 1*b*) and is actuated by both cams (14, 15).

43 Claims, 9 Drawing Sheets

U.S. PATENT DOCUMENTS

| | | | | |
|---|---|---|---|---|
| 4,522,085 | A | 6/1985 | Kane | |
| 4,917,058 | A | 4/1990 | Nelson et al. | |
| 5,136,887 | A | 8/1992 | Elrod et al. | |
| 5,253,622 | A | 10/1993 | Bornstein et al. | |
| 6,098,581 | A | 8/2000 | Buck et al. | |
| 6,789,521 | B2 | 9/2004 | Ashida et al. | |
| 2002/0170514 | A1 * | 11/2002 | Methley | 123/90.16 |

FOREIGN PATENT DOCUMENTS

| | | |
|---|---|---|
| DE | 2921645 | 12/1980 |
| DE | 3531000 | 8/1986 |
| DE | 19600536 | 7/1997 |
| DE | 19701203 | 7/1998 |
| EP | 0596860 | 5/1994 |
| EP | 1375843 | 1/2004 |
| FR | 1109790 | 2/1956 |
| WO | 9416202 | 7/1994 |

OTHER PUBLICATIONS

English Abstract of DE19701203.
English Abstract of DE19600536.
English Abstract of DE3531000.
English Abstract of WO94/16202.

* cited by examiner

INTERNAL COMBUSTION ENGINE

BACKGROUND OF THE INVENTION

1. Field of the Invention

The invention relates to an internal combustion engine with at least one cylinder and at least one gas exchange valve controlled by a first cam on a first camshaft and by a second cam on a second camshaft, with at least one camshaft having an adjustable phase position in order to modify the control times of the gas exchange valve, with the first cam acting upon an actuating means and the second cam acting upon an actuating means which actuates the gas exchange valve, with the actuating means being arranged in such a way that the gas exchange valve opens only when both the first cam and the second cam are acting upon the actuating means. The invention further relates to an apparatus for engaging an additional cam elevation for an internal combustion engine with at least one gas exchange valve that can be actuated via a cam of a camshaft, comprising at least one pressure body which is held in a displaceable manner in a radial transverse bore of the camshaft preferably in the region of the base circle of the cam and which is adjustable by means of an actuating rod which is arranged in a displaceable manner axially within the camshaft between at least two positions, with the actuating rod comprising at least one ramp surface in the contact area of the pressure body, with the path of displacement of the pressure body being delimited in the transverse bore radially to the outside and/or the twistability of the pressure body in the transverse bore being limited. The invention further also relates to an internal combustion engine with a variable valve actuating device with at least a divided cam arrangement which comprises at least one cam fixedly connected to the camshaft and at least one additional cam which is twistable between at least two positions about a rotational axis parallel to the camshaft axis.

2. The Prior Art

It is known that internal combustion engines can be optimized in such a way that the valve control times of the intake and exhaust valves are changed depending on the respective operating state.

Such a measure allows increasing both the engine output as well as reducing fuel consumption and exhaust gas emissions. One known possibility for realizing such a change in the valve control times is to slightly twist the camshaft relative to the normal position, which camshaft performs the actuation of the respective valve. It is obvious that in this manner the duration of the valve opening and the valve lift during the opening cannot be changed.

A method and an apparatus for changing the valve control times are known from EP 0 596 860 A, in which each cam is composed of two semi-cams which can be twisted relative to each other. It is thus possible to change the duration of the valve opening. In order to enable the adjustment of the semi-cams independent from each other, an inside shaft is provided within a hollow drilled camshaft which can be twisted relative to the camshaft. Although it is possible in this way to set the start of the valve opening as well as the end of the valve opening within certain limits independent from each other, the valve lift is still predetermined and the apparatus is in addition complex and costly.

A further solution for realizing valve control times in which the opening and closing movement can be changed independent from each other is described in EP 0 909 882 A. A valve is actuated by two camshafts, of which one substantially initiates the valve opening movement and the other the valve closing movement. It is also disadvantageous in this solution that the valve lift cannot be changed and that the mechanical complexity is high.

An internal combustion engine is known from EP 1 375 843 A of the applicant which comprises a valve actuating mechanism which offers an improvement of the solutions as described above. The valve actuation occurs in a hydraulic manner. This hydraulic actuation is undesirable in some cases when hydraulic requirements are opposed to the same.

DE 24 56 752 shows a purely mechanical solution which offers an only very limited adjusting range however.

Apparatuses for engaging an additional cam elevation are used for exhaust gas recirculation devices, decompression devices and exhaust gas braking devices.

In MTZ February 2003, annual edition 64, page 100, a switchable camshaft for an engine brake is known, comprising an apparatus for engaging an additional cam elevation for an internal combustion engine of the kind mentioned above. The path of displacement and the twistability of the pressure body is delimited by two buckles screwed onto the surface of the camshaft on both sides of the pressure body. The number of the parts is relatively high, mounting is complex and operational reliability over prolonged operating periods is not ensured.

A decompression device with an actuating rod arranged within a camshaft is known from EP 1 247 951 A2, comprising a ramp surface formed by a circumferential groove, through which a pin can be radially displaced in the region of a cam base circle. The actuating rod is actuated by means of a cable pull.

U.S. Pat. No. 1,439,798 discloses a decompression device with an actuating rod arranged in a camshaft, which actuating rod comprises ramp surfaces in the region of a pin arranged radially in the camshaft in the region of a base circle of a cam, which ramp surfaces act upon the pin. By sliding the actuating rod in the direction of the longitudinal axis of the camshaft, the radial pin slides along the ramp surfaces and is displaced in the radial direction. The extension and retraction of the radial pin occurs in a desmodromic manner.

Furthermore, simple valve actuation devices with rigid additional cams are known which ensure an internal recirculation of exhaust gas in a cost-effective and reliable manner. The missing deactivation capability in the case of additional cam elevation is disadvantageous in certain load cases in the exhaust gas cycle.

A variable valve actuation device for an internal combustion engine is known from U.S. Pat. No. 5,136,887 which comprises a cam that can be twisted by means of a control source arranged within the camshaft.

U.S. Pat. No. 4,498,352 shows a camshaft arrangement with a divided cam. The two partial cams can be twisted relative to each other by means of a control shaft arranged within the hollow camshaft. FR 1 109 790 A shows a similar cam arrangement with divided cams.

Camshaft arrangements with divided cams are further known from the publications U.S. Pat. No. 4,522,085 and DE 29 21 645 A1, with the cams being twistable relative to each other by means of a control shaft arranged as a pull rod. In order to ensure this, the control shaft comprises grooves extending in an inclined or screw-like manner on its jacket surface, into which engage projections of the cam parts twistably arranged on the camshaft.

Further camshafts with divided cam arrangement in which two cam parts can be twisted against each other are known from the publications WO 94/19585 and U.S. Pat. No. 4,917,058 A. One of the two cam parts is twisted by an outer twisting device relative to the other cam part.

The known arrangements all have the disadvantage that they require a high number of components of complex constructional configuration, which thus substantially increases the amount of production work.

It is the object of the present invention to provide an internal combustion engine with a valve control which avoids such disadvantages and allows for high degrees of freedom in setting the valve opening times and the height of lift of the valve movement. The advantages of the solution known from EP 1 375 843 A shall be achieved by a purely mechanical solution, with the complexity being as low as possible, so that a cost-effective production and maintenance can be ensured. It is a further object of the invention to provide a cost-effective, sturdy and reliable apparatus for engaging an additional cam elevation in the simplest possible way. It is a further object of the invention to reduce the constructional effort for a variable valve actuating device in an internal combustion engine of the kind mentioned above.

SUMMARY OF THE INVENTION

These objects are achieved in accordance with the invention in such a way that the actuating means comprises a lever which actuates the gas exchange valve and is actuated by both cams.

The relevant aspect in the invention is the actuating means which comprises a lever or is arranged as a lever which controls the gas exchange valve depending on both camshafts. A simplification of the mechanical configuration is achieved by the solution in accordance with the invention and the height of the valve lift can also be influenced.

In a first embodiment of the invention, the actuating means is arranged as a two-arm lever whose ends are actuated by the cams and whose middle section is in connection with at least one actuating lever for actuating at least one gas exchange valve. A stop can ensure that the valve or valves will only open when both cams act upon the respective actuating means. The shapes of the cam are arranged in such a way that the first cam will actuate the actuating means before the earliest possible valve opening time. This means that only the second cam will carry out the actual valve opening. The second cam is arranged in such a way that it will still actuate the actuating means even at the latest possible valve closing time, so that the valve is closed when the first cam ends the actuation of the actuating means. As a result of the independent adjustment of the two camshafts, the opening and closing movement of the gas exchange valve can be influenced independent from each other. When the closing movement is initiated before the opening movement is completed it is also possible to reduce the valve lift in a simple manner. It is also possible in a simplified embodiment of the invention to provide only one of the two camshafts in an adjustable way, so that the valve opening time is fixed, but the valve closing time can be changed. The full advantages of the invention are only achieved however when both camshafts are adjustable independent from each other.

A solution of the invention which is especially advantageous in a constructional respect is given when the first cam acts via a first rocker arm and the second cam via a second rocker arm on the actuating means. An especially simple configuration can be achieved in such a way that the first rocker arm and the second rocker arm are held on a common axle.

In order to ensure that at every time at least one rocker arm acts upon the actuating means, it can be provided in a preferred manner that one of the two rocker arms comprises a preferably adjustable driver for the other rocker arm, as a result of which the same will be actuated when the other is not actuated. The setting can be made for example by a screw on the driver which allows changing the coordination of the rocker arms accordingly.

The present invention is principally suitable for all kinds of internal combustion engines, i.e. especially also for such internal combustion engines with spark ignition and such with self-ignition. The valve control in accordance with the invention can trigger as a gas exchange valve both an intake valve as well as an exhaust valve, or both intake valves as well as exhaust valves can be controlled independent from each other in a variable manner.

An especially simple embodiment of the internal combustion engine is achieved when the gas exchange valve which is controlled by the first camshaft and the second camshaft is an intake valve and the exhaust valve is controlled by the first camshaft. As a result, the control of the intake and exhaust valves can make do with two camshafts. In this case, the control times of the exhaust valve are fixedly coupled with the opening movement or with the closing movement of the intake valve.

A valve bridge for actuating several similar gas exchange valves can be provided in an internal combustion engine with three or more valves per cylinder. Two intake valves can be opened and closed simultaneously in this way for example.

A non-defined position of the lever mechanism can be avoided in a preferred embodiment of the invention in such a way that the first cam and the second cam each comprise a base circle section, an elevation section and two transitional sections, and that the sum total of the elevation sections is at least as large as the sum total of the base circle sections, so that when a cam is situated in the base circle section, the other cam is situated in the elevation section. The size of the described sections is defined by the respective axial angle. It is thus also ensured that the sum total of the cam elevations always exceeds a certain predetermined minimum value, so that the system will operate in a play-free manner at all times.

A simple and reliable engagement of an additional cam elevation can be achieved in such a way that the transverse bore comprises at least one longitudinal groove in which a securing element engages which is rigidly connected with the pressure body, with the longitudinal groove and the securing element forming a loose guide means.

The path of the displacement of the pressure body radially to the outside can be delimited when the length of the longitudinal groove is smaller than the length of the transverse bore, with the maximum radial extension of the longitudinal groove in the camshaft, measured away from the rotational axis of the camshaft, being smaller than the radial extension of the cam in the region of the transverse bore.

The transverse bore is formed only on one side between the surface of the cam and the cavity of the camshaft.

In an embodiment which is simple to produce it is provided that the longitudinal groove is preferably formed as a guide bore preferably formed as a pocket bore parallel to the transverse bore in the region of the edge of the transverse bore, with the diameter of the guide bore preferably being smaller than half the diameter of the transverse bore. The guide bore starts out from the side of the surface of the cam averted from the transverse bore.

In a preferred embodiment of the invention it is provided that the pressure body is formed by a cylindrical pin whose diameter corresponds maximally to the diameter of the transverse bore. In order to avoid point-shaped pressure loads on the outside of the pin, it is advantageous when an outer first face side of the pin averted from the cavity of the camshaft comprises a convex cylinder surface. The radius of the cylinder surface should be as large as possible in order to keep the Hertzian contact pressure as low as possible. It is relevant in this respect that the pin is arranged in the transverse bore to be twist-proof in such a way that the axis of the cylinder surface of the first face side is aligned parallel to the rotational axis of the camshaft.

The inner second face surface of the pin facing the cavity of the camshaft can either comprise a convex cylinder surface or a convex spherical surface.

A single guide bore in the region of the jacket of the transverse bore is sufficient for delimiting the path of displacement and as an anti-twist device, especially when the pressure body is formed by cylindrical pin. It is also possible to provide two diametrically opposite guide bores in the region of the jacket of the transverse bore.

The securing element can be formed by at least one securing pin which is arranged in a preferably radial receiving bore of the pin, with the diameter of the securing pin corresponding at most to the width of the longitudinal groove.

As an alternative to a cylindrical pin it can be provided that the pressure body is formed by at least one rolling body whose largest roll-off diameter corresponds at most to the diameter of the transverse bore whose rotational axis is arranged normally to the axis of the transverse bore, with the rolling body preferably being guided in the region of its rotational axis by the securing element along the longitudinal groove, preferably along two diametrically opposed longitudinal grooves.

In order to reduce the Hertzian contact pressure as a result of the valve actuating elements, it is advantageous when the rolling body comprises a cylindrical first rolling surface. In order to enable a rolling off within the transverse bore, the rolling body may comprise spherical second rolling surfaces on either side of the first rolling surface.

The securing element can be arranged in a simple embodiment here too by a securing pin in the area of the rotational axis of the rolling body whose diameter corresponds at most to the width of the longitudinal groove.

When at least two rolling bodies are used, then it is advantageous when they are connected by the securing element with each other, with the securing element being formed preferably by at least one ring or bracket guided in the longitudinal groove.

The actuating rod is actuated by means of a mechanical, hydraulic, pneumatic or electric actuating device, optionally in combination with a restoring spring. In order to keep the holding forces in the adjusting position as low as possible, it is especially advantageous when the ramp surface of the actuating rod comprises at least two, preferably at least three, flattened portions for the pressure body which each define a stable position for the pressure body.

It is further provided for within the scope of the invention that the actuating rod comprises at least one application bore for mounting or dismounting the pressure body, with the diameter of the application bore corresponding at least to the diameter of the transverse bore and with the application bore being brought into alignment with the transverse bore in at least one position of the actuating rod, with the application bore preferably being arranged normal to the rotational axis of the camshaft. An especially simple mounting or dismounting of the apparatus is thus possible. A rapid and correctly positioned installation of the pressure body is possible when longitudinal application grooves are arranged in the region of the jacket surface of the application bore, whose position, number and arrangement correspond to the longitudinal bores of the transverse bore, with the longitudinal application bores being brought in at least one position of the actuating rod in alignment with the longitudinal grooves of the transverse bore.

An installation which is correctly positioned is decisive for the functional reliability of the apparatus especially in the case of pressure bodies arranged in an asymmetric way, e.g. when the first face side of the pin comprises a cylindrical surface and the second face side of the pin comprises a spherical surface. In order to prevent wrong mounting to the highest possible extent it is provided that the actuating rod comprises a position securing means for the installation of the pressure body which is correctly positioned. It is preferably provided that the securing element is arranged closer to the first face side than the second face side of the pressure body as a position securing means and that the length of the longitudinal application grooves is smaller starting out from a first side of the actuating rod facing the transverse bore than half the maximum longitudinal extension of the pressure body.

The constructional effort can be kept as low as possible when the camshaft comprises a cylindrical guide surface for the additional cam on which the additional cam is held in a displaceable manner in the circumferential direction. It is preferably provided that the additional cam substantially has the shape of an open annulus whose inside radius corresponds substantially at least to the radius of the cylindrical guide surface of the camshaft. This enables a very simple shaping of the additional cam.

It is especially advantageous when the additional cam comprises two arms which encompass the camshaft along the cylindrical guide surface about an encompassing angle of more than 180°, preferably by 210° to 240°, which arms enable a diametrical fixing through a positive locking on the camshaft. The two arms of the additional cam allow for an interlocking connection with the camshaft, with the additional cam being held in a twistable manner relative to the camshaft. The additional cam is simply pressed onto the camshaft from the side during mounting, with the arms briefly deforming in an elastic way.

The additional cam is connected in a torsionally rigid manner with a selector shaft arranged within the camshaft, with the connection preferably being made via a pin with a cylindrical or oval cross section. The additional cam is applied in such a way to the camshaft that the pin immerses partly into an opening of the additional cam. It is provided that the camshaft comprises a radial opening in the region of the guide surface, with the width of the opening as measured in the direction of the camshaft axis corresponding at least to the thickness of the pin as measured in the direction of the camshaft axis. It is advantageous when, as seen in a cross sectional view transversally to the camshaft axis, the opening extends about an angular range in the circumferential direction of approximately 60° to 120° about the camshaft axis. The additional cam can thus be twisted via the pin by the selector shaft within the camshaft, with the opening angle of the opening defining the adjusting range.

It is provided for in an especially preferred embodiment of the invention that the cylindrical guide surface is arranged as a radially circumferential groove in the fixed cam, with the width of the groove corresponding at least to the width of the additional cam. The additional cam should be provided with the narrowest possible arrangement, which is possible by the choice of the shape of the cam and the merely small effective valve spring force as a result of the small cam lift.

The additional cam is twisted by the selector shaft between an idle position and at least one active position. It can be provided that the additional cam is arranged in its idle position radially within the cam elevation of the fixed cam.

It can be provided in an especially simple embodiment that the guide surface is arranged concentrically relative to the camshaft axis.

A further embodiment of the invention provides that the guide surface is arranged in an eccentric manner relative to the camshaft axis.

The middle of the cylindrical guide surface is slightly offset with respect to the camshaft axis approximately to the side of the fixed cam averted from the highest camshaft elevation. The advance angle can thus be reduced. In order to enable an unhindered twisting movement of the additional cam it is provided that the pin is connected in an axially movable manner with the additional cam.

The invention is now explained in greater detail by reference to embodiments shown in the drawings.

DETAILED DESCRIPTION OF THE PREFERRED EMBODIMENTS

Figure 1:
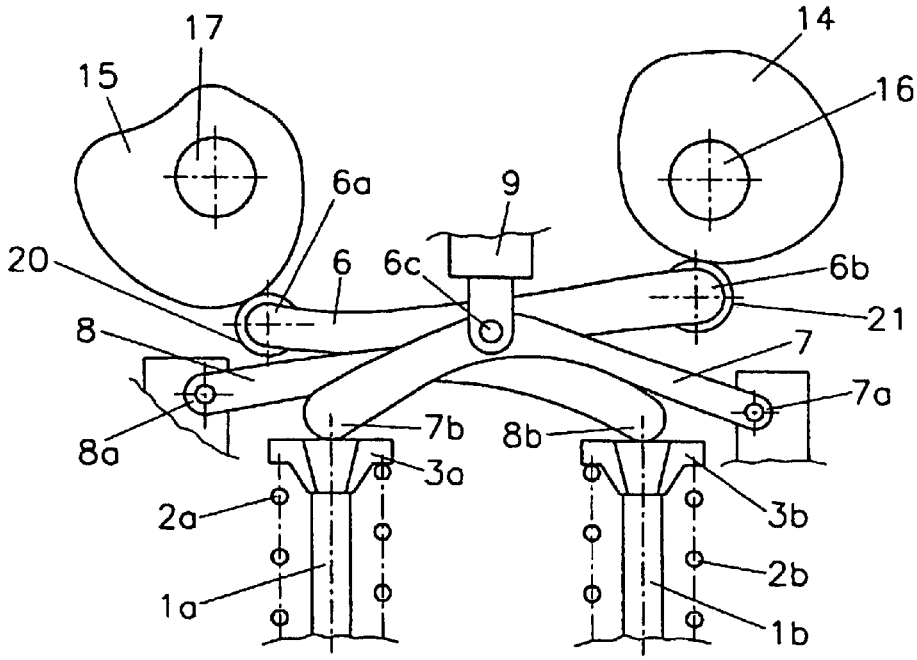
FIG. 1 shows an embodiment of the invention in a sectional view.

FIG. 1 shows the part of an internal combustion engine which is relevant for the invention. A cylinder (not shown in closer detail) is associated with two gas exchange valves 1*a*, 1*b* which can each be intake valves or exhaust valves. The gas exchange valves 1*a*, 1*b* are biased to the closed position in the known manner by valve springs 2*a*, 2*b* resting on disks 3*a*, 3*b*.

A two-arm lever 6 with rollers 20, 21 at the ends 6*a*, 6*b* is actuated on the one hand by a first cam 14 which is arranged on a first camshaft 16 and on the other hand by a second cam 15 which is arranged on a second camshaft 17.

The lever 6 is held on two actuating levers 7, 8 which are held at their first ends 7*a*, 8*a* and each actuate at their second ends 7*b*, 8*b* one gas exchange valve 1*a*, 1*b*. In order to ensure the mobility of the lever 6, it is possible to provide one of the two bearings of lever 6 in a slightly displaceable manner on the actuating levers 7, 8 by means of an oblong hole for example (not shown). A stop 9 in the middle section 6*c* of lever 6 ensures that the middle section 6*c* is situated at the same height when none or precisely one of the two cams 14, 15 is in the elevated position.

Figure 2:
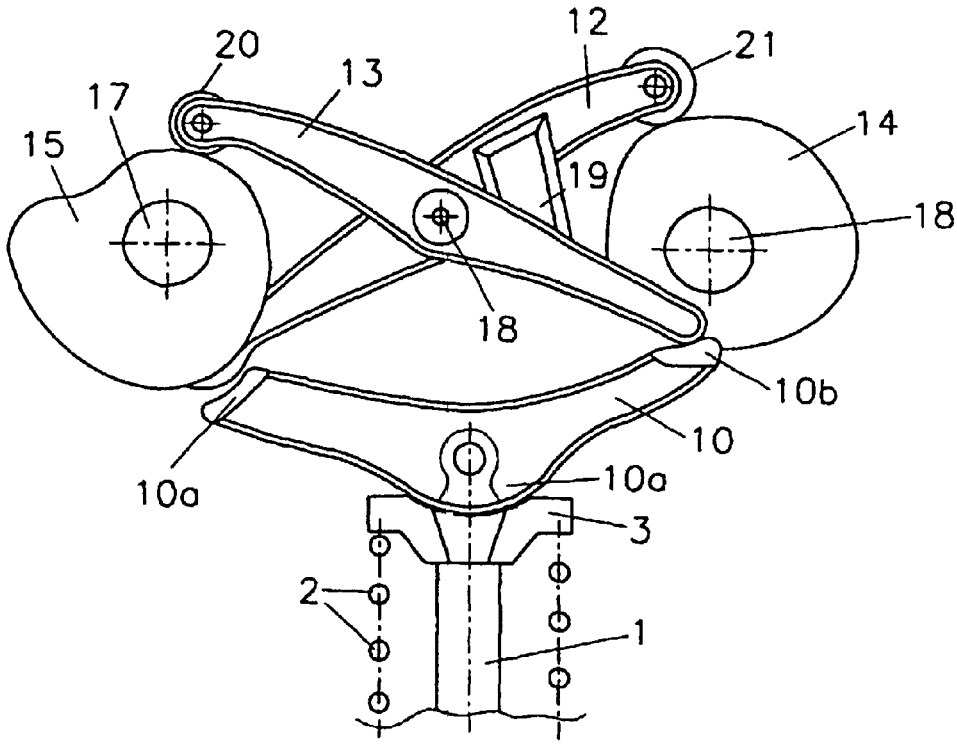
FIG. 2 shows an alternate embodiment of the invention in a sectional view.

In the embodiment of FIG. 2, a single gas exchange valve 1 with a valve spring 2 and a valve disk 3 is actuated by a lever 10 which on its part is actuated by rocker arms 12, 13. The first and second rocker arm 12, 13 are held on a common axle 18. The first rocker arm 12 comprises an attached driver 19 which actuates the second rocker arm 13 when the first rocker arm 12 is not actuated. The lever 10 is arranged as a two-arm lever which comprises a valve actuation section 10*c* in its middle region and which comprises cam actuation sections 10*a*, 10*b* at its ends.

Figure 3:
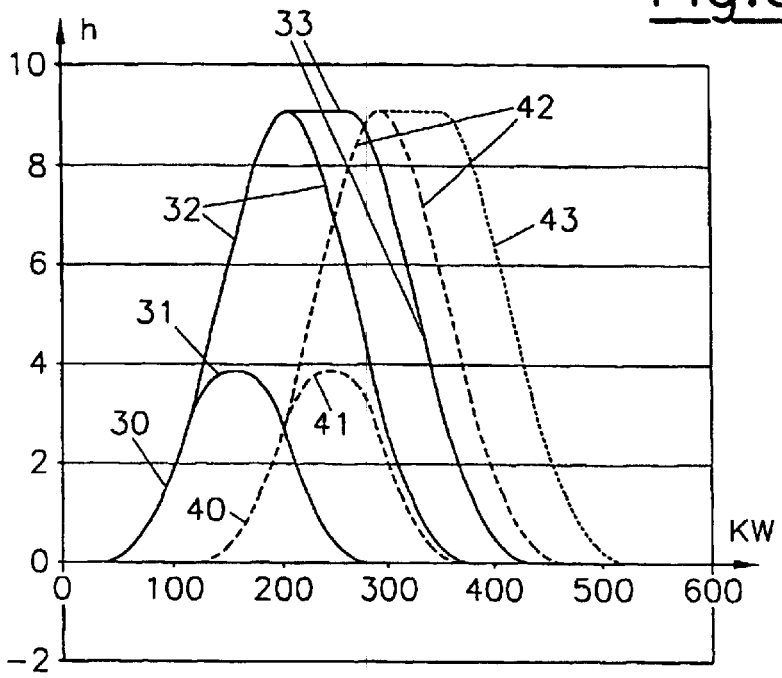
FIGS. 3 and 4 show diagrams for explaining the function of the invention in the embodiments of FIGS. 1 and 2.

The diagram of FIG. 3 shows the variability of the valve drive in accordance with the invention on the basis of a diagram. Said diagram is relevant for both embodiments as described above. The valve lift h is entered over the crank angle KW in random units. Reference numeral 30 designates a first curve section which corresponds to an early opening of the gas exchange valve 1. Depending on the determination of the closing time, the curve section 30 continues in the curve sections 31, 32 or 33, with 31 corresponding to a very early closing, 32 to a medium closing and 33 to a late closing. It can be seen that in the case of an early closing according to curve 31 the maximum valve lift h is not achieved because the closing movement already begins before the opening movement has been completed. In an analogous manner, further curves 40, 41, 42 and 43 are entered with broken lines, which curves correspond to the curves 30, 31, 32 and 33, with a later valve opening time being given. The length of the valve opening and the lift corresponding to the curves 41, 42 and 43 are identical to those in the case of the curves 31, 32 and 33.

Figure 4:
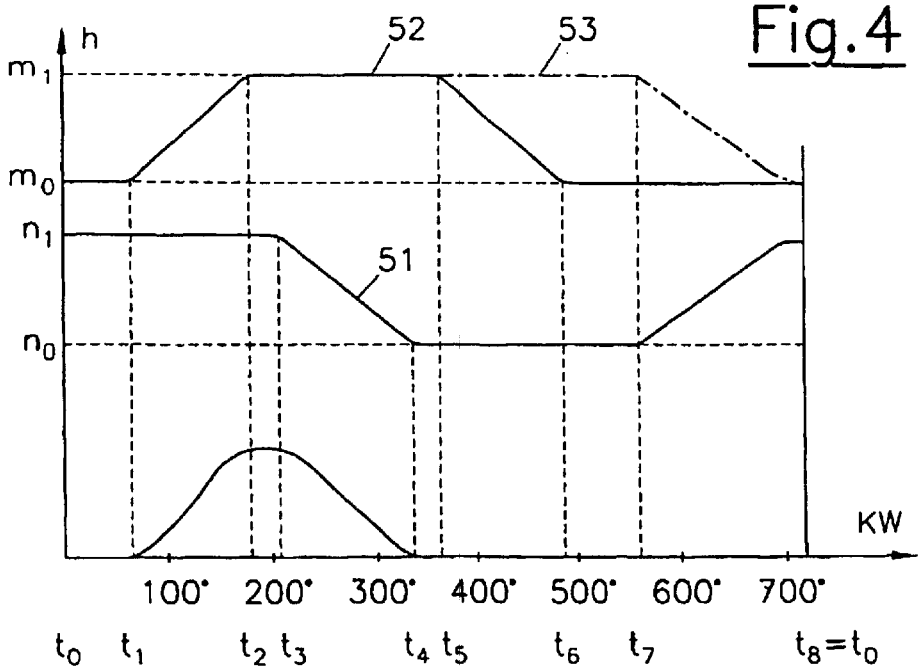

FIG. 4 shows in a diagram the correlation between the position of the cams 14, 15 and the valve opening. Curve 51 represents the elevation of the first cam 14 which changes between $n_0$, the base circle, and $n_1$, the cam elevation. In analogy to this, curve 52 represents the situation at the second cam 15 which changes between the base position $m_0$ and the elevated position $m_1$. At a time $t_0$, which corresponds to a crank angle of 0°, the first cam 14 is in the elevated position $n_1$ and the second cam 15 is in the basic position $m_0$. The gas exchange valve 1 is accordingly in its closed position.

At time $t_1$ the ascending flank begins on cam 15, which flank continues until time $t_2$ at which the second cam 15 reaches the elevated position $m_1$. This time interval between $t_1$ and $t_2$ corresponds to the opening movement of gas exchange valve 1. Up to time $t_3$ both cams 14, 15 remain in the elevated position $n_1$, $m_1$, and the gas exchange valve 1 remains completely opened. Between the times $t_3$ and $t_4$ the first cam 14 drops to its base circle at $n_0$ and accordingly the gas exchange valve 1 closes and remains completely closed from time $t_4$. At a random time $t_5$, which must in any case lie after the latest possible time $t_4$, the descending flank of the second cam 15 begins, as is shown in curve 52. Since the driver 19 of the first rocker arm 12 holds down the second rocker arm 13, the same lifts off from the second cam 15, thus obtaining a fictitious cam curve 53 which is shown with the dot-dash line. The time $t_6$ corresponds to reaching the base circle of the second cam 15, which is irrelevant for the system however. The ascending flank of the first cam 14 starts with a respective movement of the first rocker arm 12 only at a time $t_7$, as a result of which the driver 19 releases the second rocker arm 13 accordingly, until the same finally sits on the second cam 15 again. At the time $t_8$ which corresponds to 720° crank angle, this movement will end and a new working cycle begins at $t_0$.

FIG. 4 shows that the second cam 15 causes the opening movement of the gas exchange valve 1, whereas the first cam 14 causes the closing movement.

Figure 5:
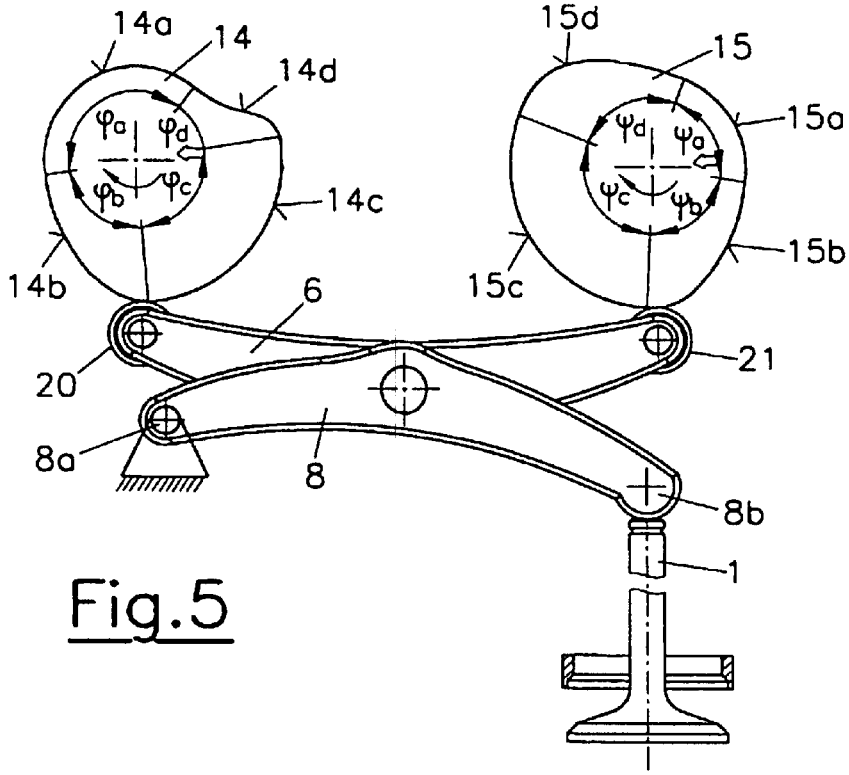
FIG. 5 shows a further embodiment of the invention in a first phase position.
Figure 6:
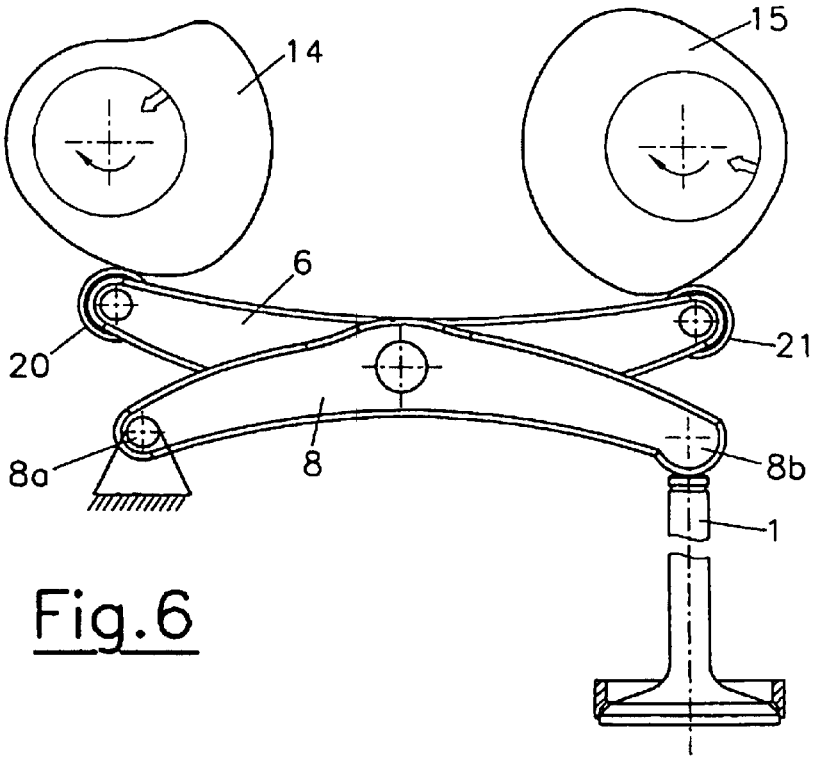
FIG. 6 shows the embodiment of FIG. 5 in a second phase position.

The embodiment of FIG. 5 and FIG. 6 is characterized by a lever 6 which acts upon an individual actuating lever 8 which is held on an end 8*a* and acts on the other end 8*b* on a gas exchange valve 1. The cams 14, 15 each comprise a base circle section 14*a*, 15*a*, an elevation section 14*c*, 15*c* and two transitional sections 14*b*, 14*d*, with 15*b*, 15*d* in between. These sections 14*a*, 14*b*, 14*c*, 14*d*; 15*a*, 15*b*, 15*c*, 15*d* correspond to axial angles $\phi_a$, $\phi_b$, $\phi_c$, $\phi_d$ and $\Psi_a$, $\Psi_b$, $\Psi_c$, $\Psi_d$, which determine the duration of the respective sections. The simultaneous meeting of the two base circle sections 14*a*, 15*a* can be prevented when the axial angles $\phi_a$, $\phi_b$, $\phi_c$, $\phi_d$ and $\Psi_a$, $\Psi_b$, $\Psi_c$, $\Psi_d$ meet the following condition:

$$\phi_a+\Psi_a, \leqq \phi_c+\Psi_c$$

Figure 7:
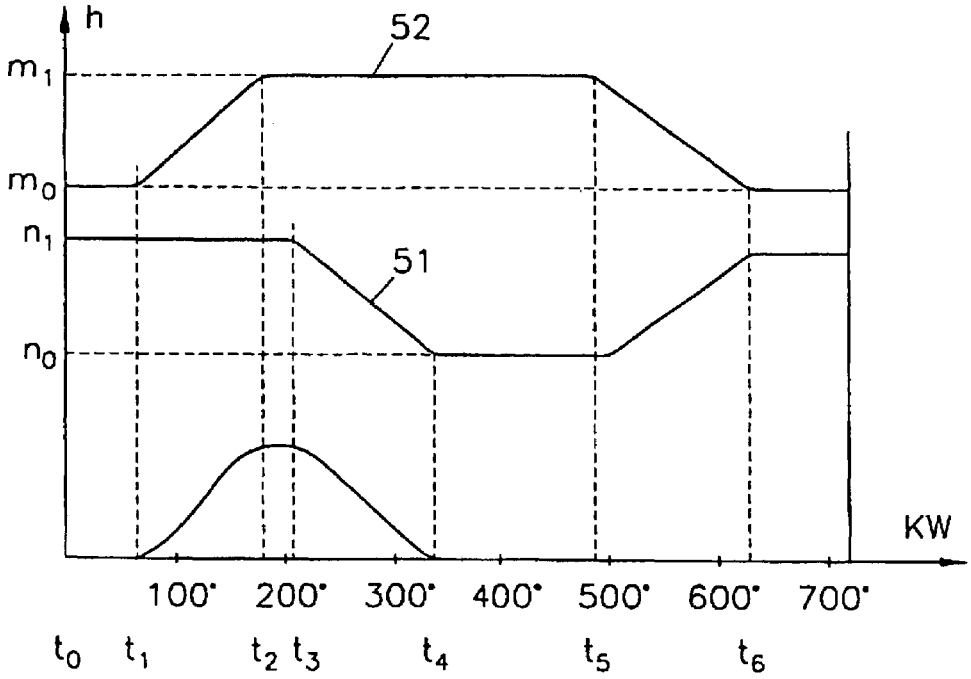
FIG. 7 shows a diagram for explaining the function of the invention according to the embodiments of FIGS. 5 and 6.

Up to time $t_4$ the diagram of FIG. 7 corresponds to that of FIG. 4. The difference is however that the ascending flank of the first cam 14 and the descending flank of the second flank 15 start approximately simultaneously at $t_5$ and end at $t_6$.

The section 14*a* of cam 14 corresponds to the time interval between $t_4$ and $t_5$, the section 14*b* to the time interval between $t_5$ and $t_6$, the section 14*c* to the time interval between $t_6$ and $t_3$, and section 14*d* to the time interval between $t_3$ and $t_4$. In analogy to this, the section 15*a* of cam 15 corresponds to the time interval between $t_6$ and $t_1$, the section 15*b* to the time interval between $t_0$ and $t_2$, and the section 15*c* to the time interval between $t_2$ and $t_5$, and section 15*d* to the time interval between $t_5$ and $t_6$.

It is clear that the opening duration of the valve can be extended by displacing the curve 51 to the left or by displacing curve 52 to the right, which is achieved by twisting the camshaft accordingly.

The present invention allows determining the valve control times in a simple manner with high degrees of freedom.

Parts with the same function are provided in the embodiments with the same reference numerals.

The apparatus 100 for engaging an additional cam elevation in a cam 102 of a camshaft 104 comprises at least one pressure body 120 which is displaceably arranged in a radial transverse bore 106 of the camshaft 104, which pressure body is positioned by means of an axially displaceable actuating rod 130 which is held in the hollow camshaft 104. The actuating rod 130 can be actuated depending on the requirements by way of a mechanical, pneumatic, hydraulic and/or electric actuating device, optionally with a restoring spring.

The path of displacement of the pressure body 120 radially to the outside and/or the twistability of the pressure body 120 in the transverse bore 106 is delimited by an interlocking connection, with the interlocking connection being formed in the embodiments by at least one longitudinal groove 108 in the region of the jacket surface 110 of the transverse bore 106, with a securing element 112 engaging in the longitudinal groove 108. Said guidance occurs loosely and prevents the transverse positioning of the pressure body 120. (The precise alignment occurs automatically via the positive engagement between the cylinder surface 127 or the rolling surface 154 and the cam tappet or the rocker arm or cam follower). In the embodiments, two longitudinal grooves 108 are provided which are situated diametrically opposite with respect to the transverse bore 106. More or fewer longitudinal grooves are possible.

For the purpose of delimiting the path of displacement of the pressure body 120 to the outside, the length $l_1$ of the longitudinal groove 108 is smaller than the length $l_2$ of the transverse bore 106, with the maximum radial extension of the longitudinal groove 108 in the camshaft 104, as measured away from the rotational axis 105 of the camshaft 104, being smaller than the radial distance of the cam contour 103 from the rotational axis 105.

In the embodiment as shown in FIGS. 8 to 11, the pressure body 120 is formed by a cylindrical pin 122. A securing pin 114 which is arranged in the pin 122 in a receiving bore 124 transversally to the axis 107 of the transverse bore 106 forms the securing element 112, with the diameter $d_1$ of the securing pin 114 corresponding at most to the width b of the longitudinal groove 108. Each longitudinal groove 108 is formed by a guide bore 116 arranged parallel to the axis 107 of the transverse bore 106. The guide bores 116 are arranged as pocket bores which start out from the surface 101 of cam 102 opposite of the transverse bore 106. The cylindrical pin 122 is prevented from dropping out because the securing pin 114 engages in the guide bores 116. The actuating rod 130 assumes the stop function for the pin 122 towards the inside of the camshaft 104. At the same time, the securing pin 114 assumes the function of an anti-twist device for pin 122 in cooperation with the guide bores 116 whose diameter $d_2$ is smaller than the radius r of the pin 122. A single guide bore 116 would be sufficient as an anti-twist device. A second guide bore 116 and a second securing pin 114 prevent a tilting of the cylindrical pin 122 however. The axis of the receiving bore 124 for the securing pin 114 is designated with 125.

Figure 12:
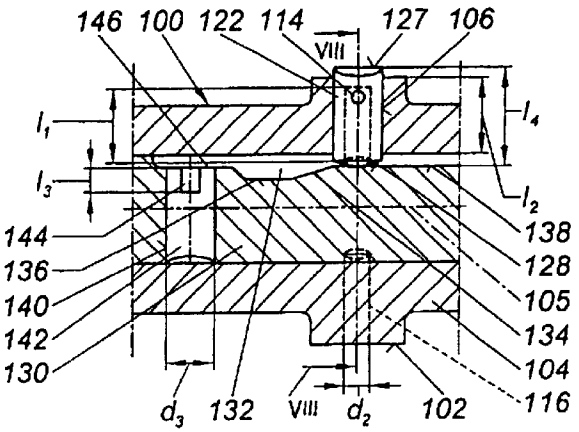
FIG. 12 shows the camshaft with the apparatus in an operating position according to the sectional view in FIG. 10.
Figure 11:
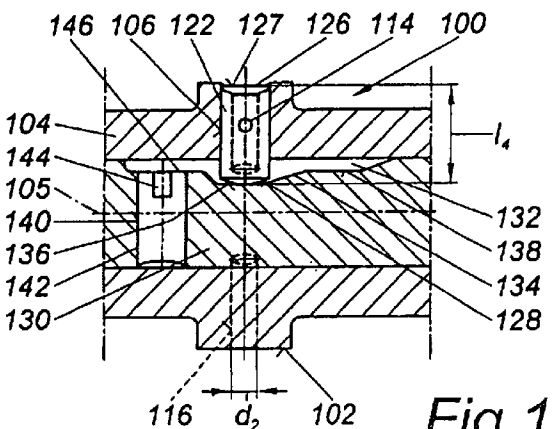
FIG. 11 shows the camshaft with the apparatus in an idle position in a sectional view according to FIG. 10.
Figure 15:
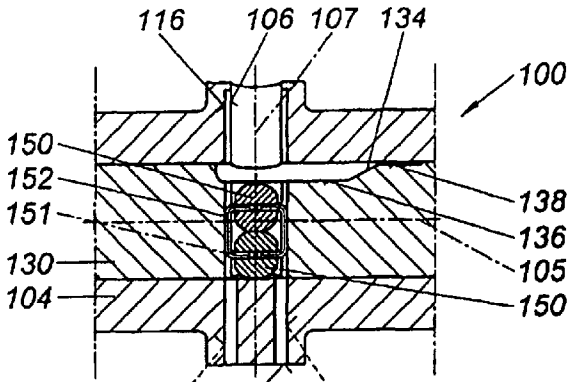
FIG. 15 shows a camshaft with the apparatus in a sectional view along line XV-XV in FIG. 13 in a mounting position.
Figure 14:
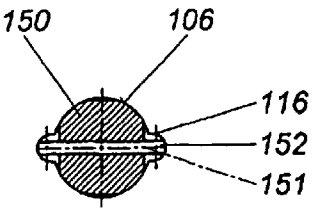
FIG. 14 shows a pressure body in a sectional view along line XIV-XIV in FIG. 13.
Figure 13:
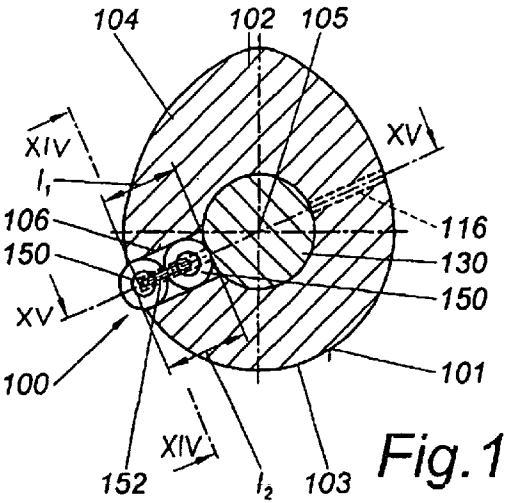
FIG. 13 shows a camshaft with the apparatus for engaging an additional cam elevation in accordance with the invention in a second embodiment in a sectional view along the line XIII-XIII in FIG. 17.
Figure 17:
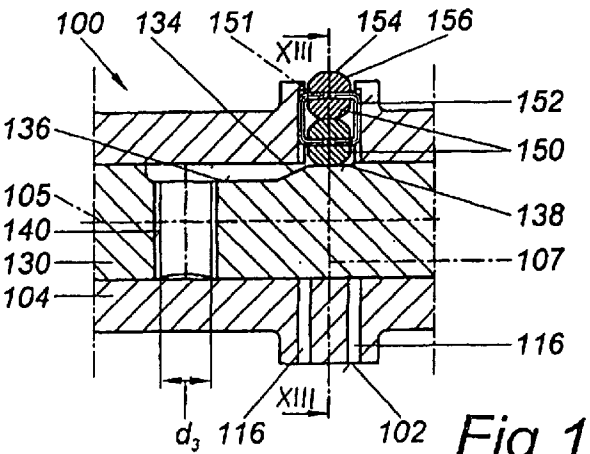
FIG. 17 shows the camshaft with the apparatus in an operating position in a sectional view in analogy to FIG. 15.
Figure 16:
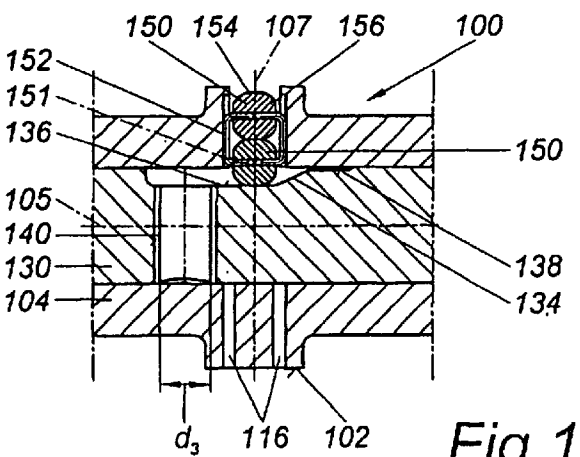
FIG. 16 shows the camshaft with the apparatus in an idle position in a sectional view in analogy to FIG. 15.

The actuating rod 130 arranged in the cavity 132 of the camshaft 104 comprises a ramp surface 134 with at least two flattened portions 136, 138 for an idle position (FIG. 11) and an operating position (FIG. 12) of apparatus 100. In the operating position as shown in FIG. 12, the pin 122 projects beyond the cam contour 103 of cam 102 and rests on the flattened portion 138 via the actuating rod 130 in camshaft 104. When the apparatus 100 is deactivated, the space available to the pin 122 is increased to such an extent in the area of the flattened portion 136 by displacing the actuating rod 130 that said pin is pushed back fully or partly into the cam contour 103 of the main cam 102 when driving over the tappet, the rocker arm or the cam follower. A zero lift or minimum lift can thus be defined and the quantity of recirculated exhaust gas can be reduced accordingly to zero or a minimum quantity. The actuating rod 130 can also be provided with three or more flattened portions 136, 138. Intermediate positions can thus also be determined between the extreme positions for the pin 122.

The cylindrical pin 122 comprises a cylinder surface 127 on its face side 126 averted from the cavity 132, with the radius of said cylindrical surface being provided with a respectively large configuration according to the Hertzian contact pressure. The axis 127*a* and/or the generatrices of the cylindrical surface 127 is/are aligned parallel to the rotational axis 105 of the camshaft 104. The pin 122 also comprises a cylinder surface 129 or a spherical surface on the second face side 128 facing the hollow chamber 132. The securing pin 114 inserted into the pin 122 or penetrating the same provides pin 122 with an orientation so that a linear contact is ensured between the pin 122 and the cam tappet or rocker arm or cam follower.

Figure 10:
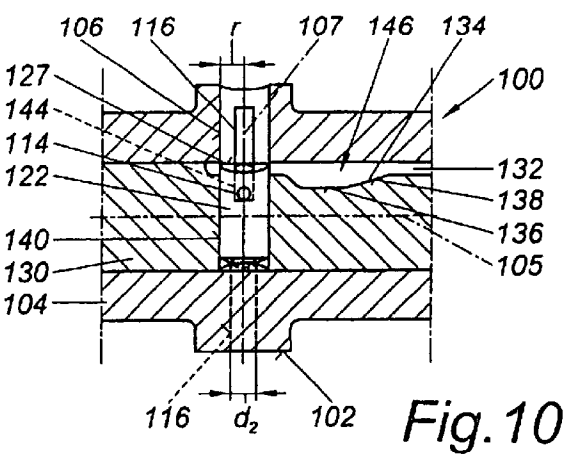
FIG. 10 shows the camshaft in a sectional view along line X-X in FIG. 9 during a mounting process.
Figure 9:
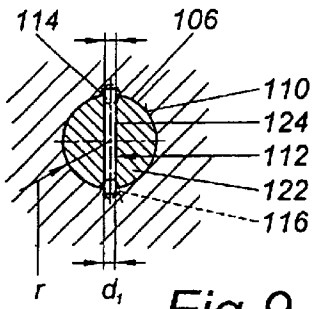
FIG. 9 shows a pressure body in a sectional view along line IX-IX in FIG. 8.
Figure 8:
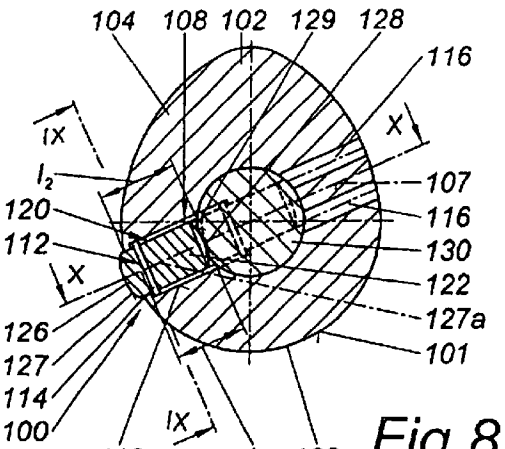
FIG. 8 shows a camshaft with an apparatus in accordance with the invention for engaging an additional cam elevation in a first embodiment in a sectional view along the line VIII-VIII in FIG. 12.

FIG. 10 shows the actuating rod 130 in a mounted position for the pin 122. Mounting occurs in such a way that the pin 122 is inserted into an application bore 140 arranged normally to the rotational axis 105 and the actuating rod 130 is pushed into the cavity 132 of the camshaft 104 until the application bore 140 comes to lie in a line with the transverse bore 106. The diameter $d_3$ of the application bore must be at least so large that the pin 122 can be housed. The pin 122 can be pushed from the actuating rod 130 to the transverse bore 106 through the two guide bores 116 on the side of the camshaft 104 averted from the transverse bore 106. The actuating rod 130 is then pushed further until the flattened portion 136 corresponding to the idle position of the apparatus 100 has been reached. The actuating rod 130 is moved even further into the camshaft 104 for the activation of the apparatus 100, this being until the pin 122 comes to lie on the flattened portion 138 corresponding to the operating position.

It is advantageous that the two small guide bores 116 (or only one of the guide bores 116) for the anti-twist device need to be guided through the surface 101 of cam 102 opposite of pin 122 and thus the cam surface is not substantially disturbed. The transverse bore 106 is machined as a pocket bore from the side of the camshaft 104 which is opposite the guide bores 116.

According to the guide bores 116 in the camshaft 104, longitudinal application grooves 144 are incorporated in the actuating rod 130 in the region of the jacket surface 142 of the application bore 140 in order to ensure that the pin 122 plus securing pin 114 are inserted in the application bore 140. Especially in the case of a pin 122 provided with an asymmetric configuration, i.e. when the pin 122 comprises in the region of the first face side 126 a cylindrical surface and in the region of the second face side 128 a spherical surface, a correctly positioned installation in the camshaft 104 is decisive for functional reliability. The arrangement of the securing pin 114 in the pin 122 and the arrangement and length of the longitudinal application grooves 144 in the actuating rod 130 can be used as position securing means. It is relevant that the receiving bore 124 for the securing pin 114 is closer to the first face side 126 than to the second face side 128. Furthermore, the length 13 of the longitudinal application grooves 144 must be smaller than half the maximum length 14 of the pin 122, starting out from a first side 146 of the actuating rod 130 facing the transverse bore 106. This prevents wrong insertion of the pin 122 into the application bore 140. For mounting, the pin 122 must be pushed with a respectively small tool through the guide bores 116 which are now only half continuous into the transverse bore 106 of the camshaft 104.

If permitted by Hertzian contact pressure, the pressure body 120 can also be formed by two rolling bodies 150, as shown in FIGS. 13 to 17. The two rolling bodies 150 are mutually connected by one or two securing brackets 152 which are guided in the longitudinal grooves 108. The guide bores 116 must lie in this case in a plane with the rotational axis 105 of the camshaft, whereas in the embodiment as shown in FIGS. 8 to 12 with cylindrical pins 122 the plane of the guide bores 116 can be twisted at will about the axis 107 of the transverse bore 106. The advantage of the embodiment with pressure bodies 120 formed by rolling bodies 150 is that a rolling contact exists with the tappet or rocker arms or cam followers and thus wear and tear and losses by friction are lower.

The rolling bodies 150 have a substantially spherical shape and are each equipped with a cylindrical first rolling surface 154, on each side of which two spherical second rolling surfaces 156 each are arranged. The cylindrical first rolling surface 154 is used for contact with the tappet, rocker arm or cam follower. The spherical second rolling surfaces 156 allow rolling off into the transverse bore 106. The rotational axis 151 of the rolling body 150 is arranged normally to the axis 107 of transverse bore 106.

The hollow camshaft 201 comprises a divided cam arrangement 202. The cam arrangement 202 consists of at least one cam 203 fixedly connected with the camshaft 201 and an additional cam 204 which, apart from the cam elevation 205, has the shape of an open annulus.

Camshaft 201 comprises a substantially circular-cylindrical guide surface 206 for the additional cam 204. The radius R of the inner ring surface 207 of the additional cam 204 corresponds substantially to the radius r' of the guide surface 206 of camshaft 201.

The additional cam 204 comprises two arms 208 which encompass the camshaft 201 by an encompassing angle $\alpha > 180°$, preferably between 210° to 240°.

The additional cam 204 is connected via a pin 209 with sufficient flexural rigidity with a selector shaft 210 rotatably held within the camshaft 201, with the pin 209 penetrating a radial opening 211 of the camshaft 201 in the region of the guide surface 206. The width of the opening 211 corresponds at least to the thickness of the pin 209. The opening 211 opens an angular section $\beta$ which is between approximately 60° to 120° and defines the switching path of the additional cam 204.

In the embodiments as shown in the FIGS. 18 to 21, the guide surface 206 is formed by a radially circumferential groove 212 in cam 203 which divides the cam 203 into two sections 203*a*, 203*b*. The width of the groove 212 corresponds approximately to the width 213 of the additional cam 204. The two flanks 214, 215 of the groove 212 form the axial guide means of the additional cam 204.

During mounting, the additional cam 204 is pressed laterally into the groove 212 and pressed onto the camshaft 201, with the two arms 208 being slightly elastically deformed. As a result of the encompassing arms 208, the additional cam 204 is connected in a captive manner with the camshaft 201. The additional cam 204 is pushed axially onto the camshaft 201 in such a way that the end 216 of the pin 209 is received by a recess 217 of the additional cam 204 and thus produces an interlocking rotational connection between the additional cam 204 and the selector shaft 210.

Figure 18:
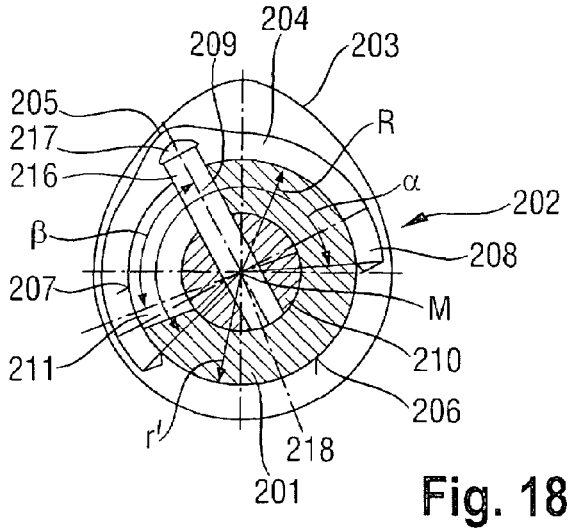
FIG. 18 shows a camshaft of an internal combustion engine in accordance with the invention in an embodiment in a cross-sectional view in an idle position of the additional cam.
Figure 19:
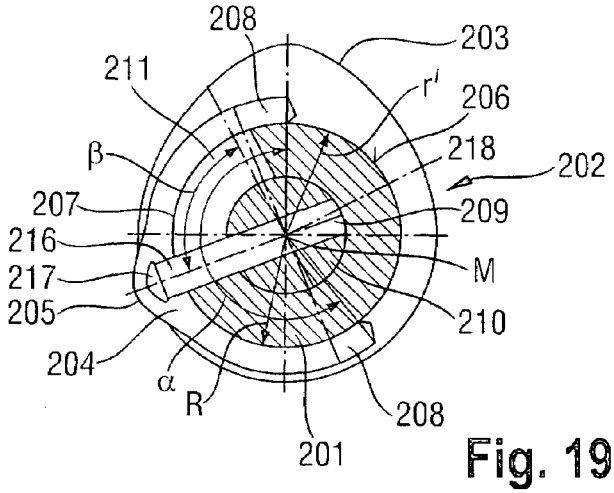
FIG. 19 shows the camshaft in a cross-sectional view, with the cam being situated in an active position.
Figure 20:
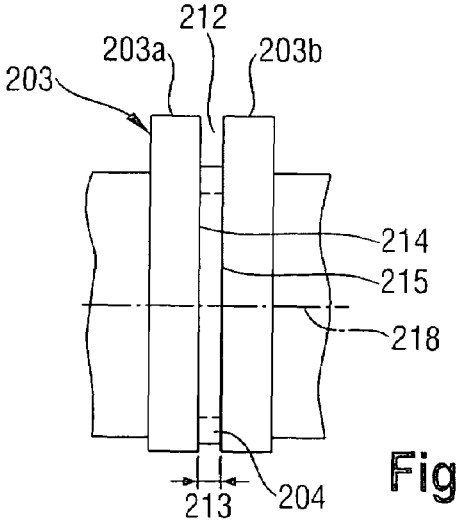
FIG. 20 shows a camshaft in a side view.
Figure 21:
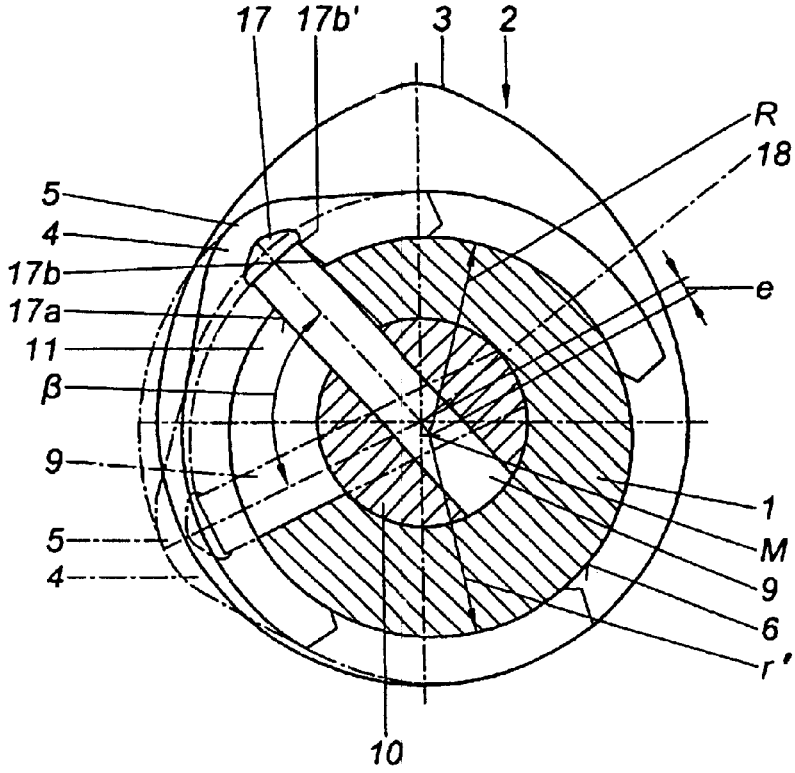
FIG. 21 shows a cross-sectional view of a camshaft of an internal combustion engine in accordance with the invention in a further embodiment.

In the embodiment as shown in FIGS. 18 and 19, the guide surface 206 is arranged concentrically to the camshaft axis 218. FIG. 21 shows a further embodiment with a guide surface 206 arranged eccentrically relative to the camshaft axis 218. The size of the advance angle $\beta$ can be reduced in such a way that the center M of the guide surface is arranged at a small distance e eccentrically to the camshaft axis 218. The additional cam 204 is in the idle position in the unbroken lines and in an active position in the dot-dash lines. In order to enable a twisting of the additional cam 204 with respect to the cam 203 despite the eccentricity e, pin 209 is loosely connected with the additional cam 204, i.e. it is longitudinally displaceable. The contact flanks 217*a*, 217*b* of the recess 217 of pin 209 in the additional cam 204 are adjusted to the eccentric displacement in order to prevent the clamping of the pin 209 during the twisting of the additional cam 204. The opposing contact flanks 217*a*, 217*b* are not aligned in parallel, as seen in the illustrated sectional view. A contact flank comprises a projection 217*b*' or a bulging, so that in this section there is only a point-shaped contact with the pin 209.

The additional cam 204 can be twisted by means of the central selector shaft 210 to the desired position, which shaft can be twisted relative to the camshaft 201. The actuation of the central selector shaft 210 is carried out by means of apparatuses used for such purposes such as a hydraulic phase actuator. Since the additional cam 204 also claims a part of the contact width of the main cam 203 for itself, it needs to be provided with the narrowest possible configuration, which is possible by the choice of the shape of the cam and the low valve spring force as a result of the small cam lift.

A preferred application is for example the performance of an internal exhaust gas recirculation into the combustion chamber of an internal combustion engine. The intake valve is opened briefly by a small value during the exhaust phase before or after the bottom dead center, which is enabled by the rotation of the additional cam 204 from the idle position as shown in FIG. 18 to the active position as shown in FIG. 19.

The invention claimed is:

1. An apparatus for engaging an additional cam elevation for an internal combustion engine with at least one gas exchange valve that can be actuated via a cam of a camshaft, comprising at least one pressure body which is held in a displaceable manner in a radial transverse bore of the camshaft and which is adjustable by means of an actuating rod which is arranged in a displaceable manner axially within the hollow camshaft between at least two positions, with the actuating rod comprising at least one ramp surface in the contact area of the pressure body, with a path of displacement of the pressure body being delimited in the transverse bore radially to an outside and/or a twistability of the pressure body in the transverse bore being delimited, wherein the transverse bore comprises at least one longitudinal groove in which a securing element engages which is rigidly connected with the pressure body, with the longitudinal groove and the securing element forming a loose guide means.

2. The apparatus according to claim 1, wherein the pressure body is held in the radial transverse bore in the region of a base circle of the cam.

3. The apparatus according to claim 1, wherein the length of the longitudinal groove is smaller than a length of the transverse bore, with a maximum radial extension of the longitudinal groove in the camshaft, as measured away from a rotational axis of the camshaft, being smaller than a radial extension of the cam in the region of the transverse bore.

4. The apparatus according to claim 1, wherein the transverse bore extends on one side between a cavity of the camshaft and a surface of the cam.

5. The apparatus according to claim 1, wherein the longitudinal groove is formed as a guide bore parallel to the transverse bore in a region of a jacket of the transverse bore.

6. The apparatus according to claim 5, wherein the guide bore is formed as a pocket bore.

7. The apparatus according to claim 5, wherein a diameter of the guide bore is smaller than half the diameter of the transverse bore.

8. The apparatus according to claim 5, wherein the guide bore starts out from a side of the surface of the cam averted from the transverse bore.

9. The apparatus according to claim 1, wherein a single guide bore is provided in the region of the jacket of the transverse bore.

10. The apparatus according to claim 1, wherein two diametrically opposite guide bores are provided in the region of the jacket of the transverse bore.

11. The apparatus according to claim 10, wherein the axes of the guide bores open up a plane substantially comprising the camshaft axis.

12. The apparatus according to claim 1, wherein the securing element can be formed by at least one securing pin which is arranged in a radial receiving bore of the pin, with a diameter of the securing pin corresponding at most to a width of the longitudinal groove.

13. The apparatus according to claim 1, wherein the pressure body is formed by a cylindrical pin whose diameter corresponds maximally to the diameter of the transverse bore.

14. The apparatus according to claim 13, wherein an outer first face side of the pin averted from the cavity of the camshaft comprises a convex cylinder surface.

15. The apparatus according to claim 14, wherein the pin is arranged in the transverse bore to be twist-proof in such a way that an axis of a cylinder surface of the first face side is aligned parallel to the rotational axis of the camshaft.

16. The apparatus according to claim 14, wherein an outer second face side of the pin facing the cavity of the camshaft comprises a convex cylinder surface or a convex spherical surface.

17. The apparatus according to claim 1, wherein the pressure body is formed by at least one rolling body whose largest roll-off diameter corresponds at most to the diameter of the transverse bore and whose rotational axis is arranged normally to the axis of the transverse bore.

18. The apparatus according to claim 17, wherein the rolling body is guided in the region of its rotational axis by the securing element along the longitudinal groove.

19. The apparatus according to claim 18, wherein the rolling body is guided along two diametrically opposed longitudinal grooves.

20. The apparatus according to claim 17, wherein the rolling body comprises a cylindrical first rolling surface.

21. The apparatus according to claim 17, wherein the rolling body comprises spherical second rolling surfaces, on either side of the first rolling surface.

22. The apparatus according to claim 17, wherein at least two rolling bodies are connected by the securing element with each other.

23. The apparatus according to claim 22, wherein the securing element is formed by at least one securing ring or securing bracket guided in the longitudinal grooves.

24. The apparatus according to claim 1, wherein the ramp surface of the actuating rod comprises at least two flattened portions for the pressure body, which each define a stable position for the pressure body.

25. The apparatus according to claim 24, wherein the ramp surface of the actuating rod comprises at least three flattened portions for the pressure body, which each define a stable position for the pressure body.

26. The apparatus according to claim 1, wherein the actuating rod comprises at least one application bore for mounting or dismounting the pressure body, with a diameter of the application bore corresponding at least to the diameter of the transverse bore and with the application bore being brought into alignment with the transverse bore in at least one position of the actuating rod.

27. The apparatus according to claim 26, wherein the application bore is arranged normal to the rotational axis of the camshaft.

28. The apparatus according to claim 26, wherein longitudinal application grooves are arranged in a region of a jacket surface of the application bore, whose position, number and arrangement correspond to the longitudinal bores of the transverse bore, with the longitudinal application bores being brought in at least one position of the actuating rod in alignment with the longitudinal grooves of the transverse bore.

29. The apparatus according to claim 26, wherein the actuating rod comprises a position securing means for a correctly positioned installation of the pressure body.

30. The apparatus according to claim 29, wherein the securing element is arranged closer to the first face side than the second face side of the pressure body as a position securing means and that the length of the longitudinal application grooves, starting out from a first side of the actuating rod facing the transverse bore, is smaller than half the maximum length of the pressure body.

31. The apparatus according to claim 1, wherein the actuating rod can be actuated mechanically, hydraulically, pneumatically or electrically.

32. An internal combustion engine with a variable valve actuating device with at least one divided cam arrangement which comprises at least one cam fixedly connected to the camshaft and at least one additional cam which is twistable between at least two positions about a rotational axis parallel to the camshaft axis, wherein the camshaft comprises a cylindrical guide surface for the additional cam on which the additional cam is held in a displaceable manner in the circumferential direction, wherein the additional cam comprises two arms which encompass the camshaft along the cylindrical guide surface about an encompassing angle of more than 180°, which arms enable a diametrical fixing through a positive lock on the camshaft.

33. The internal combustion engine according to claim 32, wherein the additional cam substantially has a shape of an open annulus whose inside radius (R) corresponds substantially at least to a radius of a cylindrical guide surface of the camshaft.

34. The internal combustion engine according to claim 32, wherein the encompassing angle is 210° to 240°.

35. The internal combustion engine according to claim 32, wherein the additional cam is connected in a torsionally rigid manner with a selector shaft arranged within the hollow camshaft.

36. The internal combustion engine according to claim 35, wherein the connection is made via a pin with a cylindrical or oval cross section.

37. The internal combustion engine according to claim 36, wherein the camshaft comprises a radial opening in a region of the guide surface, with a width of the opening as measured in a direction of the camshaft axis corresponding at least to a thickness of the pin as measured in the direction of the camshaft axis.

38. The internal combustion engine according to claim 37, wherein as seen in a cross sectional view transversally to the camshaft axis, the opening extends about an angular range in a circumferential direction of approximately 60° to 120° about the camshaft axis.

39. The internal combustion engine according to claim 32, wherein the additional cam is arranged in its idle position radially within a cam elevation of the fixed cam.

40. The internal combustion engine according to claim 32, wherein the guide surface is arranged concentrically to the camshaft axis.

41. An internal combustion engine with a variable valve actuating device with at least one divided cam arrangement which comprises at least one cam fixedly connected to the camshaft and at least one additional cam which is twistable between at least two positions about a rotational axis parallel to the camshaft axis, wherein the camshaft comprises a cylindrical guide surface for the additional cam on which the additional cam is held in a displaceable manner in the circumferential direction, wherein the cylindrical guide surface is arranged as a radially circumferential groove in the fixed cam, with a width of the groove corresponding at least to a width of the additional cam.

42. An internal combustion engine with a variable valve actuating device with at least one divided cam arrangement which comprises at least one cam fixedly connected to the camshaft and at least one additional cam which is twistable between at least two positions about a rotational axis parallel to the camshaft axis, wherein the camshaft comprises a cylindrical guide surface for the additional cam on which the additional cam is held in a displaceable manner in the circumferential direction, wherein the guide surface is arranged eccentrically to the camshaft axis.

43. The internal combustion engine according to claim 42, wherein the pin is connected in an axially sliding manner with the additional cam.

* * * * *